US005092762A

United States Patent [19]

Yang

[11] Patent Number: 5,092,762

[45] Date of Patent: Mar. 3, 1992

[54] RADIAL VANE SWIRL GENERATOR

[75] Inventor: Shyh-Ching Yang, Hsinchu, Taiwan

[73] Assignee: Industrial Technology Research Institute, Hsinchu, Taiwan

[21] Appl. No.: 642,858

[22] Filed: Jan. 15, 1991

[51] Int. Cl.[5] ..... F23M 9/00

[52] U.S. Cl. ..... 431/184; 239/402.5

[58] Field of Search ..... 431/184, 181, 185, 182; 239/402.5, 403, 404, 405

[56] References Cited

U.S. PATENT DOCUMENTS

| | | | |
|---|---|---|---|
| 2,041,535 | 5/1936 | Frisch | 431/184 |
| 2,144,098 | 1/1939 | Baker | 431/184 |
| 2,838,103 | 6/1958 | Voorheis | 431/184 |
| 3,145,670 | 8/1964 | Copian et al. | 431/184 |
| 3,932,110 | 1/1976 | Waddell | 431/184 |
| 4,927,352 | 5/1990 | Chung | 431/184 |

*Primary Examiner*—James C. Yeung
*Attorney, Agent, or Firm*—Cushman, Darby & Cushman

[57] ABSTRACT

Improved radial vanes of a swirl generator, which are rotatably radially disposed at the fluid outlet of a bellow, wherein a handle device is used to make the radial vanes rotate within 0–80 range for adjusting the air swirl intensity required by the burner, the fluid flowing through the vanes to directly coil into the combustion chamber so as to avoid the drawbacks of high pressure drop and high turbulent flow intensity occurring at the inlet of a burner.

12 Claims, 7 Drawing Sheets

RADIAL VANE SWIRL GENERATOR

BACKGROUND OF THE INVENTION

The present invention relates to a radial vane swirl generator, and more particularly to rotatable radial vanes of a swirl generator.

A burner is one of the most important parts in the combustion system. The capability of the burner not only has great influence on the combustion efficiency but also closely relates to the stability of the flame, the effective application of the fuel and the discharge of pollutant.

Improper combustion technology and improper selection of burners not only influences the effective use of energy, but also results in air pollution due to emitting large amount of hazardous material by combustion.

Conventional burner applies a fan or a compressor to send the air into the combustion chamber to mix with the fuel for burning. The blades of such conventional burner are of fixed radial type. The practicians often apply low-excess-air combustion technics to industrial boiler. Moreover, by means of fuel gas recirculation, the peak temperature of flame can be reduced to control thermal-NO. Swirling flow generated by properly-designed swirl generator and fuel-gas recirculation can control the residence time of combustion gas and flame temperature so that controlling fuel-rich combustion, reducing peak temperature of flame, controlling residence time of combustion gas and partial fuel-rich combustion and increasing stability of flame are several important keys of advanced burner design.

When air flows through the fixed radial flow-guiding vanes to form swirling flow, if the pressure drop and turbulent intensity are too high, then the capability of the burner will be poor, and the flow-guiding vanes are fixed so that the swirl intensity thereof is fixed and can not be adjusted in accordance with combustion state to achieve a best combustion condition.

Therefore, a good swirl generator must have changeable swirl flow so as to achieve low pressure drop, low turbulent intensity and be capable of producing desired recirculation intensity and controlling partial fuel-rich combustion, lowering peak temperature, controlling residence time of combustion gas and increasing flame stability.

The swirler of this invention can produce swirling flow to change the speed of air flow and deflect the radial incoming flow to produce a divisional angular vector. The swirling air flow then passes through expansion quarrel to form the recirculation.

Generally, there are three manners of generating swirling flow field:

1. manner of tangential entry;
2. manner of guided vanes; and
3. manner of rotating pipe.

In this invention, radial vanes are used to produce required swirling flow field.

When the swirling flow passing through combustion chamber, bluff body and expansion chamber, the swirling air flow will create reverse pressure gradient to form a recirculation zone. Not only is fuel vigorously mixed with air around this recirculation zone, but also a portion of the hot combustion product gas is recirculated back to sustain proper ignition, thereby assuring flame stability.

Swirling flow has the good quality of increasing flame stability. The proper swirling flow generated by properly-designed swirl generator can control flame, maintain fuel-rich combustion, reduce peak temperature of flame, control residence time of combustion gas, inhibit creation of pollutant.

The radial vanes of this invention is designed to achieve swirl level under the lowest pressure drop and the lowest turbulent intensity. The rotatable radial vanes of this invention are capable of decreasing the pressure drop and turbulent intensity. The proper rotary angle of the radial vanes is within a 0–80 range to give a tangential momentum to radially guided flow and the swirl intensity can be changed following the rotary angle of the vanes to achieve a circulation zone for enhancing the stability of the flame.

SUMMARY OF THE INVENTION

It is a primary object of this invention to provide a swirl generator with rotatable radial vanes the rotary angle of which is within a 0–80 range to produce changeable swirl intensity so as to prevent high pressure drop and high turbulent flow and achieve the objects of more complete combustion, good mixing, high efficiency and low pollution, etc.

The present invention can be best understood through the following description and accompanying drawings wherein:

DETAILED DESCRIPTION OF THE PREFERRED EMBODIMENT

Figure 1:
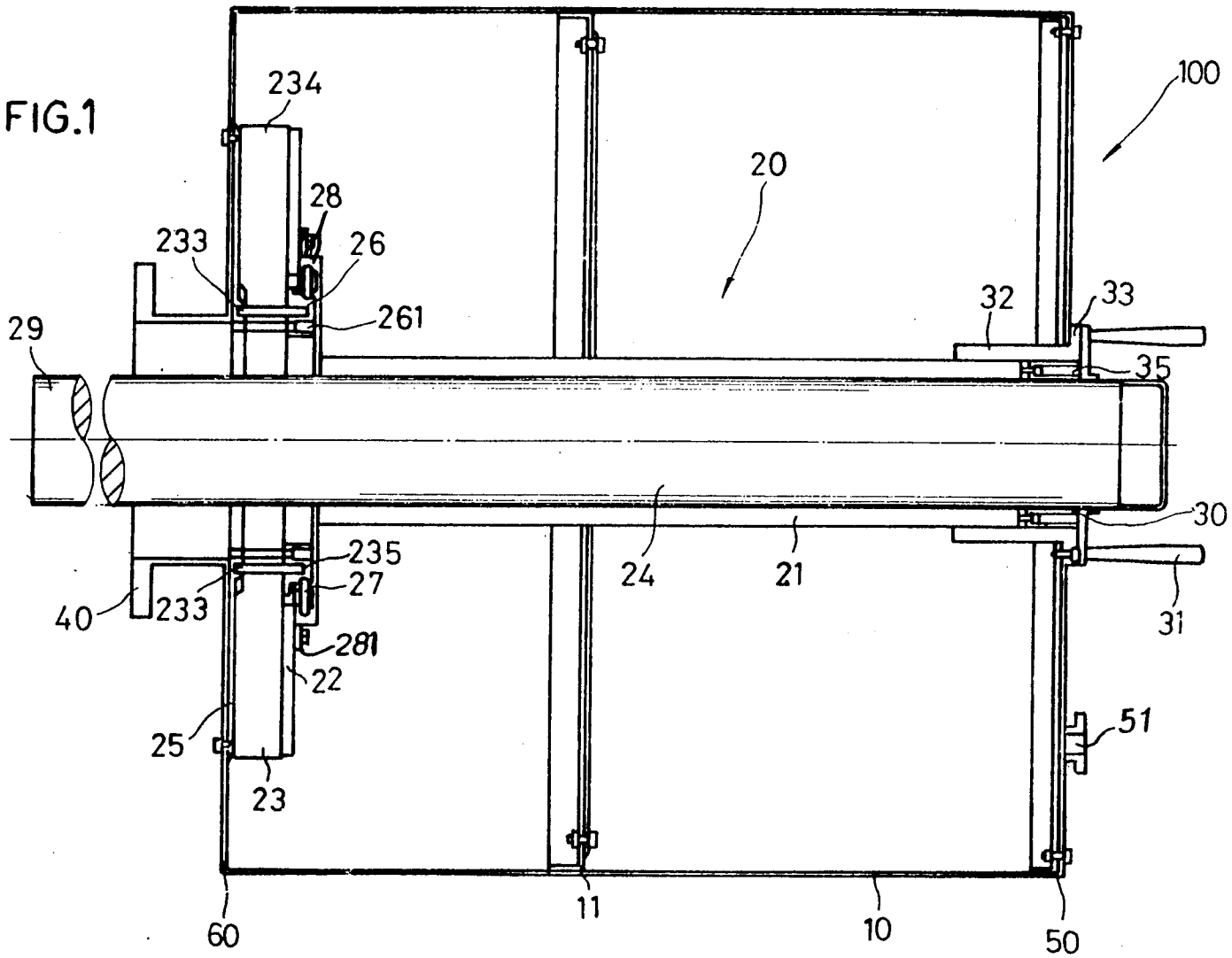
FIG. 1 is a sectional view of the bellow of the radial vanes of the swirl generator of the present invention.
Figure 2:
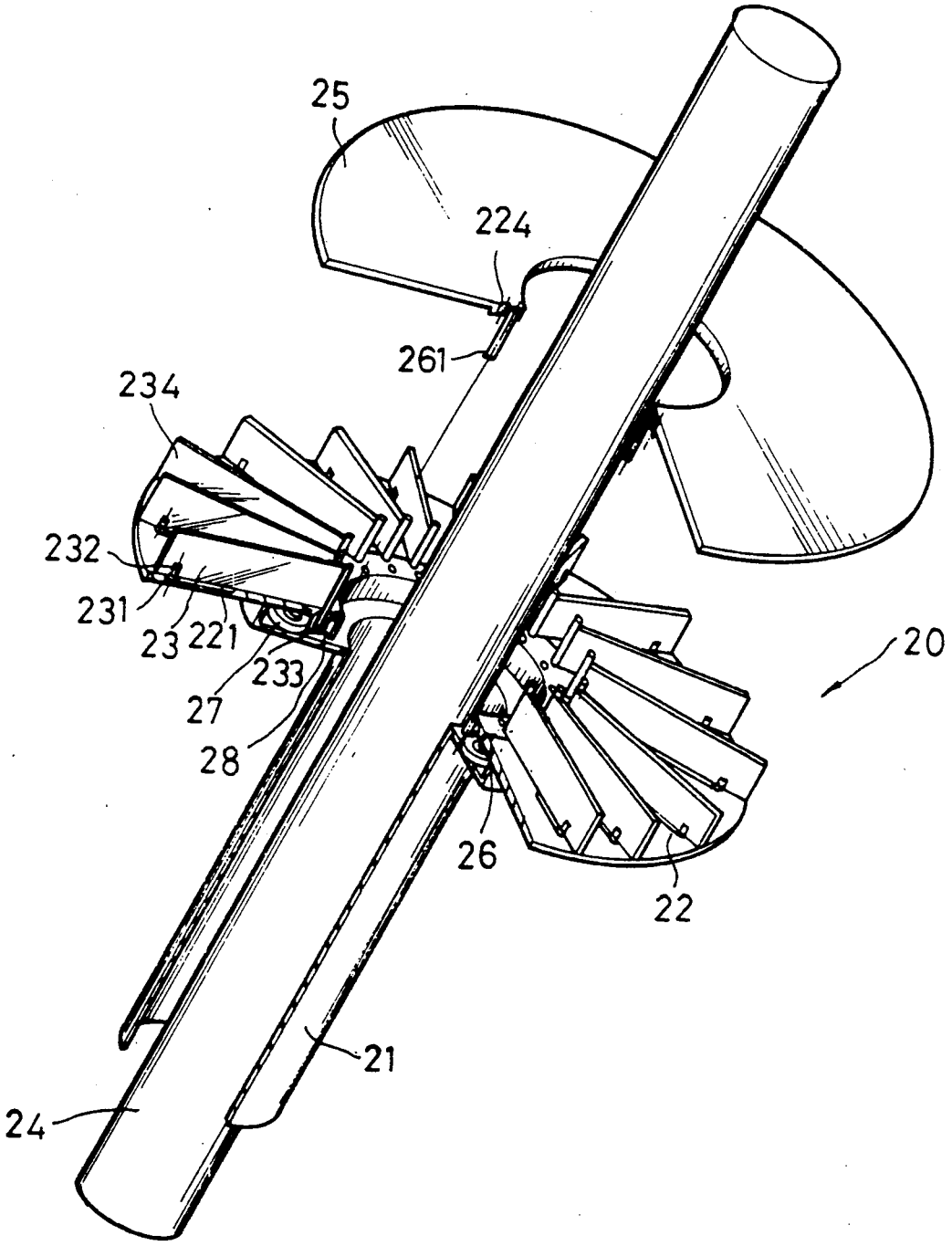
FIG. 2 is a perspective exploded view of the radial vanes thereof.
Figure 6:
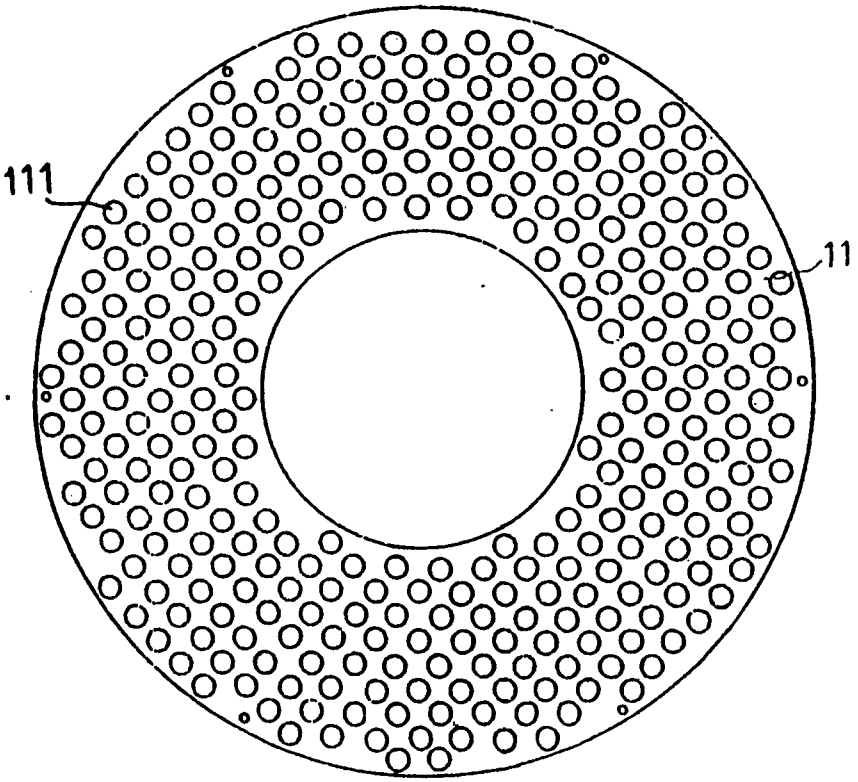
FIG. 6 is a front elevation of the beehive board of the radial vanes of this invention.
Figure 8A:
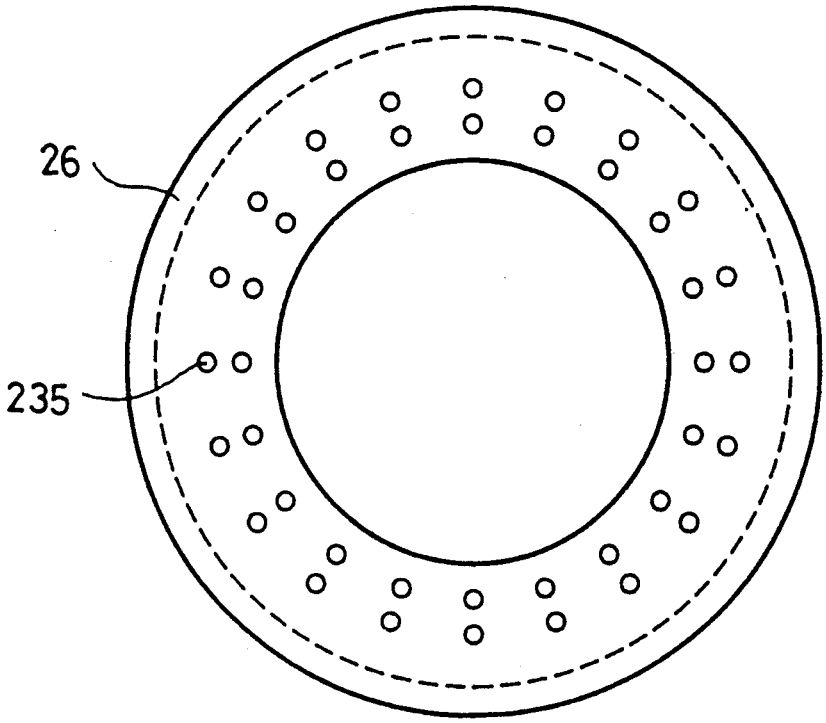
FIG. 8A shows a front elevation of the wheel seat of the radial vanes of the swirl generator of this invention.
Figure 8B:
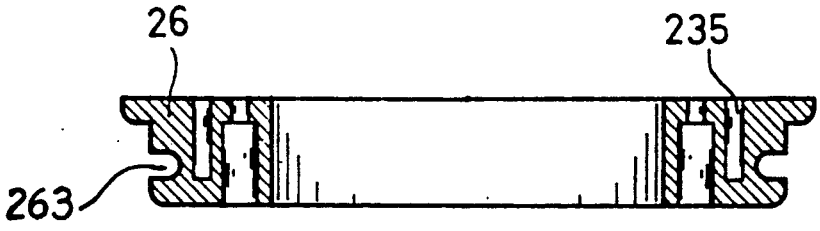
FIG. 8B shows a side view according to FIG. 8A.

Please refer to FIGS. 1 and 6, wherein the bellow 100 of this invention includes a cylindrical housing 10, adapted to be fitted in an air pathway to a combustion chamber, having a first end, a second end, a central portion and an air inlet, an inner board 50 having a central hole, an outer board 60 also having a central hole, a beehive board 11 also having a central hole, a central shaft holding block 30, a biasing block 40 and radial vane mechanism 20. The inner board 50 and outer board 60 are respectively fitted to two ends of the cylindrical housing 10. The beehive 11 is welded at middle portion of the housing 10. Multiple vent holes 111 are formed on the beehive board 11 for the air flow to go therethrough. The radial vane mechanism 20 goes through the central holes of the inner board 50, beehive board 11 and outer board 60 and extend throughout the central portion of the housing 10 to be supported and fixed thereon. Two ends of the radial vane mechanism 20 are engaged with the central holes of the inner board 50 and outer board 60 respectively by means of the central shaft holding block 30 and biasing block 40.

Figure 3B:
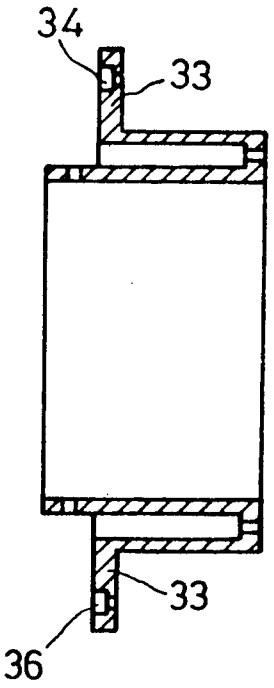
FIG. 3B is a side view according to FIG. 3A.
Figure 3A:
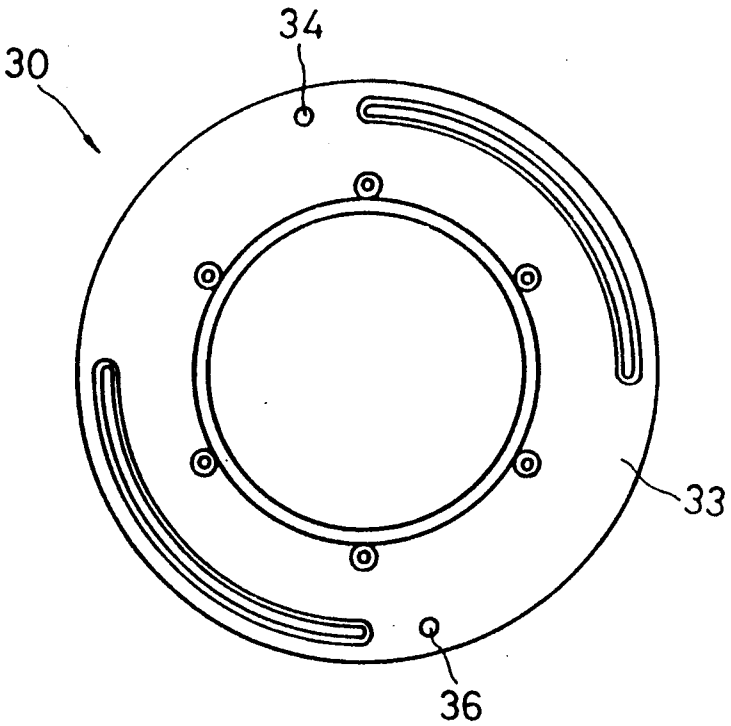
FIG. 3A is a front elevation of the central shaft holding block of the radial vanes thereof.
Figure 4B:
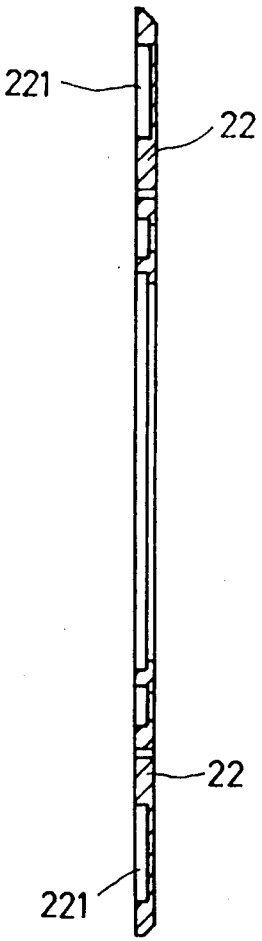
FIG. 4B is a side view according to FIG. 4A.
Figure 4A:
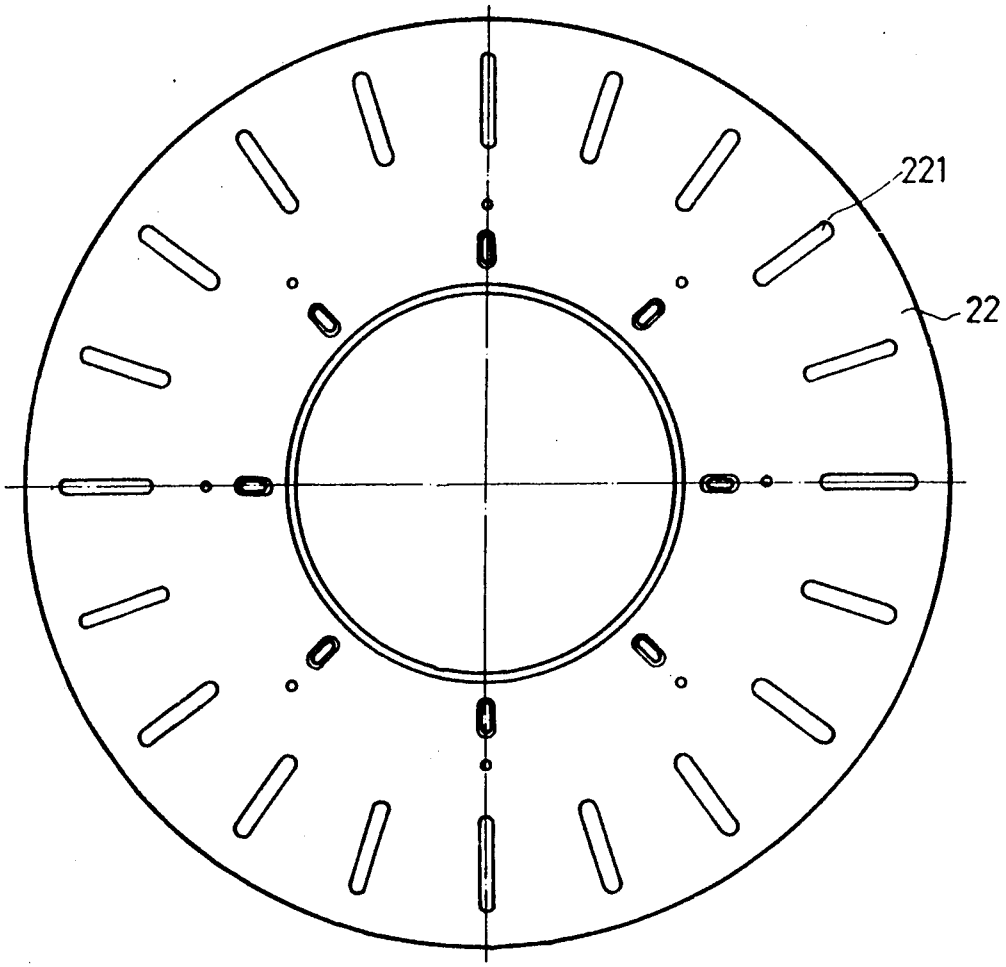
FIG. 4A is a front elevation of the bellow drive disk of the radial vanes of the swirl generator of this invention.
Figure 5B:
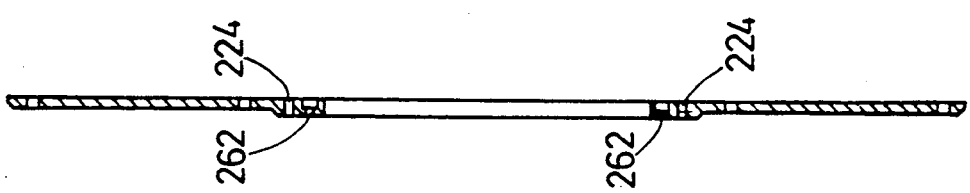
FIG. 5B is a side view according to FIG. 5A.
Figure 5A:
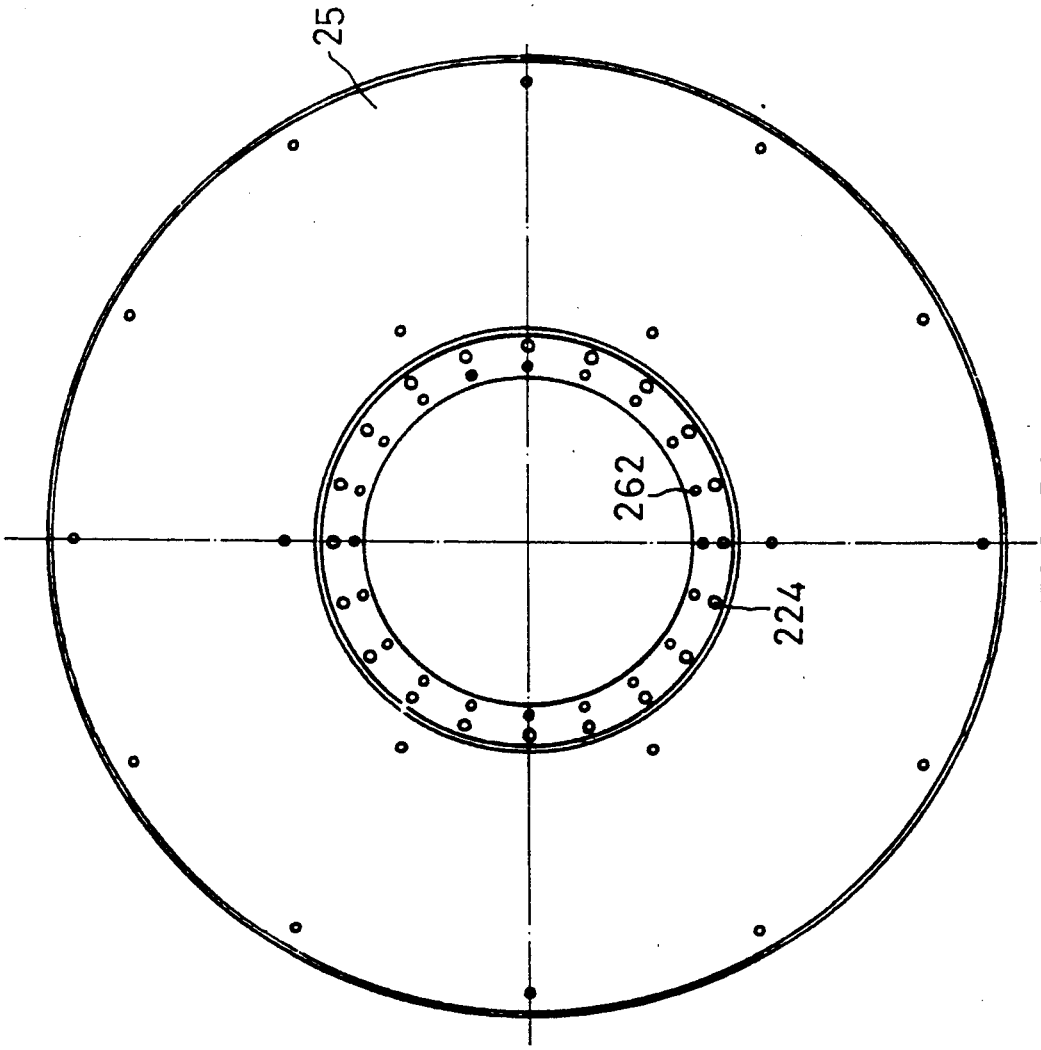
FIG. 5A is a front elevation of the fixing disk of the radial vanes of the swirl generator of this invention.

Please now refer to FIGS. 1, 3A and 3B, wherein the central shaft holding block 30 is a sleeve-like controlling block the outer circumference of which is associated with a sleeve 32 so as to engage with the inner board 50. The central shaft holding block 30 has an outer flange portion 33 formed with two opposite thread holes 34, 36 whereby two handles 31 are secured in the thread holes 34, 36 of the flange portion 33 so as to fasten the holding block 30 to the sleeve 32. The holding block 30 is further fixed with a rotary sleeve 21 by pin members 35.

Please now refer to FIGS. 2, 4A, 4B, 5A, 5B, 8A, 8B, wherein the radial vane mechanism 20 includes the fixing disk 25, drive disk 22, central shaft 24, rotary sleeve 21, wheel seat 26, rotary disk 28 and multiple identical radial vanes 23. The radial vane mechanism 20 is disposed in the central portion of the bellow 100. The central shaft 24 goes through the rotary sleeve 21. Inside the central shaft 24 are disposed fuel-spraying system and ignition system. One end of the rotary sleeve 21 is engaged with the central shaft holding block 30 located on the inner board 50 while the other end thereof is engaged with the rotary disk 28 located beside the drive disk 22. The wheel seat 26 and drive disk 22 is associated with the fixing disk 25 located on the outer board 60 by means of several pin members 261. The fixing disk 25 is formed with pin holes 262 for the pin members 261 to engage therewith. Between the drive disk 22 and fixing disk are disposed a plurality of radial vanes.

A plurality of same size pulleys 27 are fixed on the drive disk 22, the rim of the pulleys 27 are inserted in a grove 263 of the wheel seat 26. A plurality of vane shaft holes 235 are formed in the wheel seat 26 for the vane shaft 233 to be disposed therein. The other end of the vane shaft 233 is inserted in the vane shaft hole 224 of the fixing disk 25. The radial vane 23 is disposed on the vane shaft 233. A guide wheel pin 232 is disposed on lateral side of an upper portion 234 of the radial vane 23. A guide wheel 231 is disposed on the guide wheel pin 232 and located in a guide wheel groove 221 of the drive disk 22. The rotary disk 28 is connected with the drive disk 22 by bolts 281. When the rotary sleeve 21 rotates, the rotary disk 28 and drive disk 22 are driven to rotate by means of the support and roll of the pulleys. At this time, the guide wheel 231 slides along the guide wheel groove 221, making the radial vane 23 included by a certain angle, i.e., the radial vane 23 can be radially seen to change within 0–80 range. The incoming air flow goes through the inner portion of the housing 10 from air inlet 51 and goes into the upper end of the radial vane 23. The inclined radial vane 23 will swirl the air flow to be sent out from the biasing block 40. The angle of the radial vane 23 can be adjusted according to required swirl intensity.

Please now refer to FIGS. 1, 2, 3A, 3B, 4A and 4B, wherein when the handle 31 rotates the central shaft holding block 30, the rotary sleeve 21 of the radial vane mechanism 20 is driven, through the rotary disk 28 wheel seat 26, and the pulleys 27 making the radial vane 23 located on the drive disk 22 rotate within 0–80 range.

According to the above arrangement, the movable radial vane 23 in the bellow 100 serves as a swirl generator and the bluff body 29 of the central shaft 24 is a fuel injecting device of a general burner. The fluid can go through the upper portion 234 of the radial vanes 23 and radially enter the radial vanes to coil around the bluff body 29 and go into the combustion chamber through the central hole of the biasing block 40.

Figure 7:
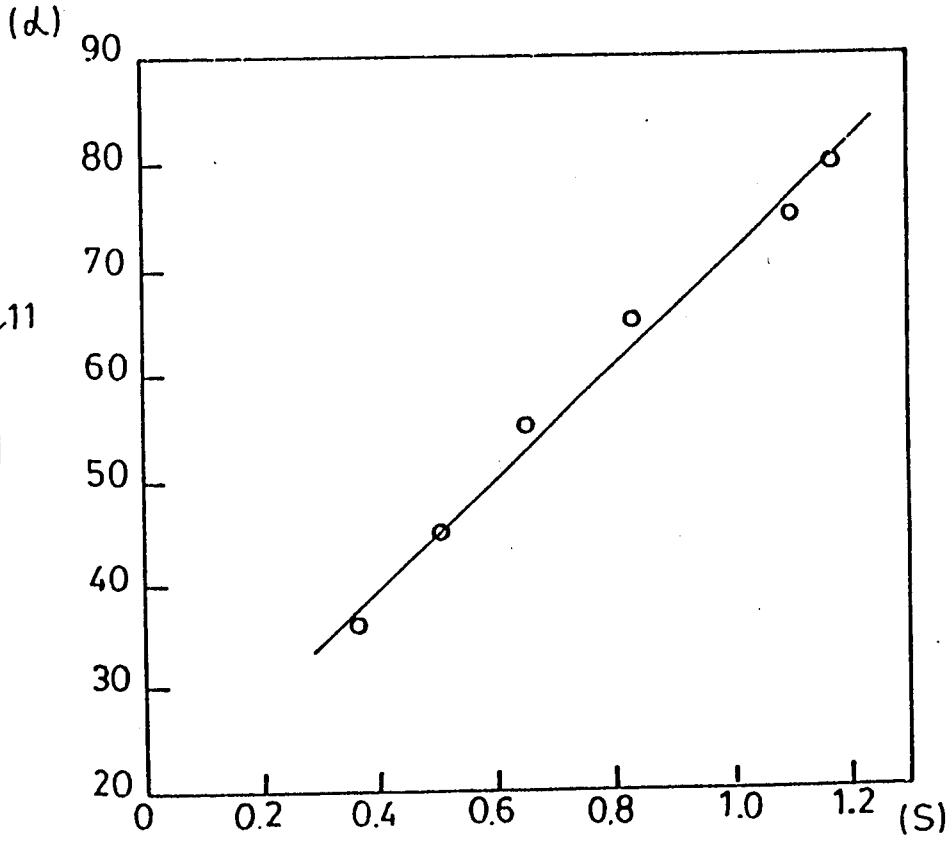
FIG. 7 shows a relationship diagram of the swirl number to the rotary angle of the radial vanes of this invention.

Please refer to FIG. 7 which shows a linear relationship between the swirl number of the improved radial vane of this invention and the rotary angle thereof. By means of the correction of an LDV experimental equipment, a good linear relationship between the rotary angle and the swirl number can be achieved, and the swirl intensity required by general industrial burner can be reached.

In FIG. 7, the X coordinate is the swirl number, and the Y coordinate is the rotary angle. We can see that when the rotary angle increases, the swirl number increases in proportion thereto. According to the data, when the swirl number increases to a certain value (about 0.6), if the pressure gradient in two opposite directions of the injected flow is sufficient to overcome the kinetic energy of the axial fluid, a central circulation zone can be produced. The circulation zone is a swirl zone which can stabilize the burning flame and increase delay time to increase combustion efficiency.

The radial vanes of this invention can eliminate the drawback existing in conventional flow-guiding vanes that the fluid passes through the vanes to force the vanes to rotate and cause mechanical loss and produce a great amount of pressure drop or great amount of pressure drop or high turbulent flow effect. Moreover, when the fluid rotates through the bluff body and enter the combustion chamber, larger radial momentum is created to reduce the energy loss caused by viscosity effect and enhance the capacity of the burner.

What is claimed is:

1. A radial vane swirl generator comprising:

a housing, adapted to be fitted in an air pathway to a combustion chamber, having a first end, a second end, a central portion and an air inlet;

an inner board fitted to said first end;

an outer board fitted to said second end;

a beehive board disposed centrally within said housing providing a passage of air flow therethrough;

a central shaft holding block fitted with said inner board;

a biasing block fitted with said outer board disposed opposite said central shaft holding block;

a radial vane mechanism disposed throughout said central portion of said housing and extending through said inner board said beehive board and said outer board being supported and engaged with said inner board by said central shaft holding block and engaged with said outer board with said biasing block, whereby air can flow into said radial vane mechanism and flow through a central hole of said biasing block into said combustion chamber, said radial vane mechanism including:

a central shaft, for carrying fuel to be disbursed into air flowing to said combustion chamber, a rotary sleeve disposed peripherally about said central shaft engaged at one end with said central shaft holding block, a rotary disk engaged with said rotary sleeve disposed opposite said central shaft holding block, a fixing disk joined to said outer board and having a plurality of holes therein, a drive disk operatively associated with said fixing disk, a wheel seat having a plurality of holes therein, means for operatively associating said wheel seat with said drive disk, a plurality of similarly constructed radial vanes disposed between said drive disk and said fixing disk, wherein said central shaft holding block drives said rotary sleeve which drives said rotary disk and said drive disk to rotate said radial vanes; and a guide wheel disposed on one side of said radial vane to move along a guide groove of said drive disk so as to make said radial vane rotate within a predetermined angular range.

2. A radial vane swirl generator as claimed in claim 1, wherein each of said housing, said inner board, said outer board, said central shaft holding block, said beehive board, and said biasing block is formed with a central hole whereby said central shaft of said radial vane mechanism, sleeved by said rotary sleeve, can extend through all of said central holes.

3. A radial vane swirl generator as claimed in claim 1, further comprising a handle for rotating said central shaft holding block.

4. A radial vane swirl generator as claimed in claim 1, wherein said beehive board is welded on said central portion of said housing and a plurality of holes are formed through said beehive board for air flow therethrough.

5. A radial vane swirl generator as claimed in claim 1, wherein said biasing block and said central shaft are formed so as to provide a gap therebetween for swirling air.

6. A radial vane swirl generator as claimed in claim 1, wherein said rotary sleeve is welded to said rotary disk to drive said rotary disk and said drive disk; said means for operatively associating said drive disk to said wheel seat comprising a plurality of same size pulleys fixed on said drive disk, with the rim of said pulley inserted in a groove of said wheel seat.

7. A radial vane swirl generator as claimed in claim 1, further comprising a pin for attaching said wheel seat with said fixing disk.

8. A radial vane swirl generator as claimed in claim 1, further comprising a vane shaft to which said radial vanes are attached, said vane shaft having two ends which are respectively inserted in said holes of said wheel seat and said fixing disk.

9. A radial vane swirl generator as claimed in claim 1, wherein said radial vane is rotated by a certain angle, the air flow goes through said beehive board and flows into the upper end of said radial vane to form swirling flow, and the swirling flow then flows through and out of said biasing block to mix with the sprayed fuel in said central shaft for combustion.

10. A radial vane swirl generator as claimed in claim 1, wherein said biasing block is welded to said outer board.

11. A radial vane swirl generator as claimed in claim 1, wherein said central shaft holding block is connected to said rotary sleeve by a pin member.

12. A radial vane swirl generator as claimed in claim 1, wherein said predetermined angular range of rotation is 0–80 degrees.

* * * * *